US006845888B2

(12) United States Patent
Verherbrugghen et al.

(10) Patent No.: US 6,845,888 B2
(45) Date of Patent: Jan. 25, 2005

(54) SYSTEM FOR FITTING A CONTAINER TO A DISTRIBUTION DEVICE AND METHOD OF USE

(75) Inventors: Hedwige Clara Theophiel Verherbrugghen, Laarne (BE); Graham John Boyd, Strombeek-Bever (BE); Carlos Gustaaf Arthur Van Lierde, Ghent (BE)

(73) Assignee: Proctor 7 Gamble Company, Cincinnati, OH (US)

( * ) Notice: Subject to any disclaimer, the term of this patent is extended or adjusted under 35 U.S.C. 154(b) by 0 days.

(21) Appl. No.: 10/370,998

(22) Filed: Feb. 20, 2003

(65) Prior Publication Data

US 2004/0007593 A1 Jan. 15, 2004

Related U.S. Application Data

(63) Continuation of application No. 09/970,554, filed on Oct. 4, 2001, now abandoned.

(51) Int. Cl.[7] ..... B67D 5/64
(52) U.S. Cl. ..... 222/162; 222/183; 222/325
(58) Field of Search ..... 222/153.01, 153.09, 222/405, 88, 325, 83.5, 82, 81, 143, 160, 162, 183.1, 321.1

(56) References Cited

U.S. PATENT DOCUMENTS 4,164,306 A 8/1979 Perrin
4,765,515 A 8/1988 Lippman
4,834,083 A * 5/1989 Byram et al. ..... 128/200.23
4,860,738 A * 8/1989 Hegemann et al. .... 128/200.22
5,141,120 A 8/1992 Brown et al.
5,328,055 A 7/1994 Battle
5,358,147 A 10/1994 Adams et al.
5,487,489 A 1/1996 Weiss et al.
5,503,302 A 4/1996 DeJonge
5,509,578 A 4/1996 Livingstone
5,791,525 A 8/1998 Fan
5,960,840 A 10/1999 Simmel et al.
5,992,698 A 11/1999 Copeland
5,992,705 A 11/1999 Lhuisset
6,401,984 B1 6/2002 Jumel
6,464,105 B1 10/2002 Rolle et al.
6,726,186 B2 * 4/2004 Gaaloul et al. ..... 261/81

FOREIGN PATENT DOCUMENTS

GB 2 334 907 A 9/1999

* cited by examiner

*Primary Examiner*—Frederick Nicolas
(74) *Attorney, Agent, or Firm*—Caroline Wei-Berk; Kim W. Zerby; Steve W. Miller

(57) ABSTRACT

An improved system for fitting a container to a distribution device, more particularly, the system and/or device is incorporated into a refreshing/cleaning apparatus for treating fabric garments, is disclosed. A method of using this fitment system to distribute the product is also disclosed.

14 Claims, 4 Drawing Sheets

SYSTEM FOR FITTING A CONTAINER TO A DISTRIBUTION DEVICE AND METHOD OF USE

CROSS REFERENCE TO RELATED APPLICATIONS

This application is a continuation of and claims priority to U.S. patent application Ser. No. 09/970,554, filed Oct. 4, 2001 now abandoned, which claims the benefit of European Patent Application No. EP 00870222.7, filed Oct. 4, 2000.

TECHNICAL FIELD

The present invention relates to an improved system for fitting a container to a distribution device, said system and/or device being preferably incorporated into a refreshing/cleaning apparatus for treating fabric garments, and said distribution device being preferably a liquid distribution device.

BACKGROUND OF THE INVENTION

Certain delicate fabrics are not suitable for conventional in-home immersion cleaning processes. Home washing machines, which provide excellent cleaning results for the majority of fabrics used in today's society, can, under certain conditions, shrink or otherwise damage silk, linen, wool and other delicate fabrics. Consumers typically have their delicate fabric items "dry-cleaned". Unfortunately, dry-cleaning usually involves immersing the fabrics in various hydrocarbon and halocarbon solvents that require special handling and the solvent must be reclaimed, making the process unsuitable for in-home use. Hence, dry-cleaning has traditionally been restricted to commercial establishments making it less convenient and more costly than in-home laundering processes.

Attempts have been made to provide in-home dry-cleaning systems that combine the fabric cleaning and refreshing of in-home, immersion laundering processes with the fabric care benefits of dry-cleaning processes. One such in-home system for cleaning and refreshing garments comprises a substrate sheet containing various liquid or gelled cleaning agents, and a plastic bag. The garments are placed in the bag together with the sheet, and then tumbled in a conventional clothes dryer. In a current commercial embodiment, multiple single-use flat sheets comprising a cleaning/refreshing agent and a single multi-use plastic bag are provided in a package.

Unfortunately, such in-home processes are designed for use in a conventional clothes dryer, or the like apparatus. Such apparatuses are not always readily available, and they are often uneconomical. Moreover, in many countries clothes dryers are simply unnecessary. For example, in many warm tropical regions people do not typically own clothes dryers because their clothes can be dried year-round by hanging them outside in the sun. In the areas of the world where people do not typically own clothes dryers, products that require a heating apparatus, such as clothes dryers, are of little or no value.

Steamer cabinets have also been utilized in the past to treat fabric articles with heavy doses of steam. Unfortunately, past steam cabinets were largely uncontrolled with respect to temperature and humidity. The cabinets were generally large appliances that were not portable. And due to the large amount of steam used, a drying step is often required that puts strain on the fabrics. The drying step also requires additional time and energy, and often results in undesirable shrinkage.

Thus, there was a need to develop a domestic, non-immersion cleaning and refreshing process, and cleaning and refreshing compositions for use therein, which provides acceptable cleaning without the need for a tumble dryer. Moreover, there is a need for apparatuses that can regulate both temperature and relative humidity within a container during a domestic, non-immersion cleaning and refreshment process, wherein dry clean only fabrics are cleaned, de-wrinkled and refreshed.

Thus, apparatuses were developed for treating a fabric article, which include a collapsible or expandable container that is made from a material that defines an interior void space having an open volume, and an opening. Such known apparatuses also include a humidity provider; a heating element; a hangar for suspending at least one fabric article within the interior void space of the container; a vent; and an air circulation device. The container can be collapsed so that the apparatus is portable. The heating element that is used in such known apparatuses is typically a steaming unit or equivalent which volatilizes the refreshing and cleaning composition by heating it up to its volatilizing temperature.

However, such apparatuses are usually provided with liquid refreshing/cleaning apparatuses via a liquid reservoir that is connected to the device, and there is a risk of leakage of such liquid containers at the time they are connected to the device. Such apparatuses are typically to be connected to the main electricity supply, and further contain electronic components that contain a large amount of electricity. Moreover, there is a risk of accidental removal of the liquid container while the device is being used, which could lead to damaging the apparatus or even injure the user. Finally, it is crucial that the connection/disconnection of the liquid container from said appliance be as easy as possible, in order to make the overall usage of the device simple to the consumer. Indeed, such apparatuses have been created to facilitate the tasks of cleaning/refreshing fabrics, so it is essential that all operations needed to operate such an appliance be as obvious and simple as possible for the consumer.

Thus, there is a need for a new fitment system that allows the user to frequently connect/disconnect a container, preferably a liquid container, to an electrical distribution device, preferably a liquid distribution device, that is connected to the main, which is extremely easy to use, and maintains the liquid container into the device in such a way that the risk of leakage is reduced to a minimum.

SUMMARY OF THE INVENTION

The present invention is primarily directed to a system for fitting a container, preferably a liquid container, to a distribution device, preferably a liquid distribution device. Said system comprises:

(i) a distribution device comprising a recess; and (ii) a container comprising a composition, said container comprising a top, a bottom, and a side wall having an external surface extending between the top and the bottom, said container being releasably engageable in said recess;

wherein (a) said recess and said container comprise a common longitudinal axis;

(b) said recess comprises a protrusion which engages a corresponding path on said surface of said side wall when said container is fitted in said recess;

(c) said path comprises a stop for said protrusion;

(d) said recess comprises an abutment for said container;

(e) said container can be fitted in said recess in a first, released position, and a second, blocked position, and a fluid communication between said container and said device can only be established when said container is fitted in said second position; and (f) said container is switcheable between said first and second positions by pushing said container once in a direction along its longitudinal axis.

The present invention is also directed to a method of using this fitment system to distribute a product, preferably a liquid product.

All documents cited are, in relevant part, incorporated herein by reference; the citation of any document is not to be construed as an admission that it is prior art with respect to the present invention.

BRIEF DESCRIPTION OF THE DRAWINGS

While this specification concludes with claims that distinctly define the present invention, it is believed that these claims can be better understood by reference to the detailed description of the invention and the drawings, wherein:

DETAILED DESCRIPTION OF THE INVENTION

Figure 1:
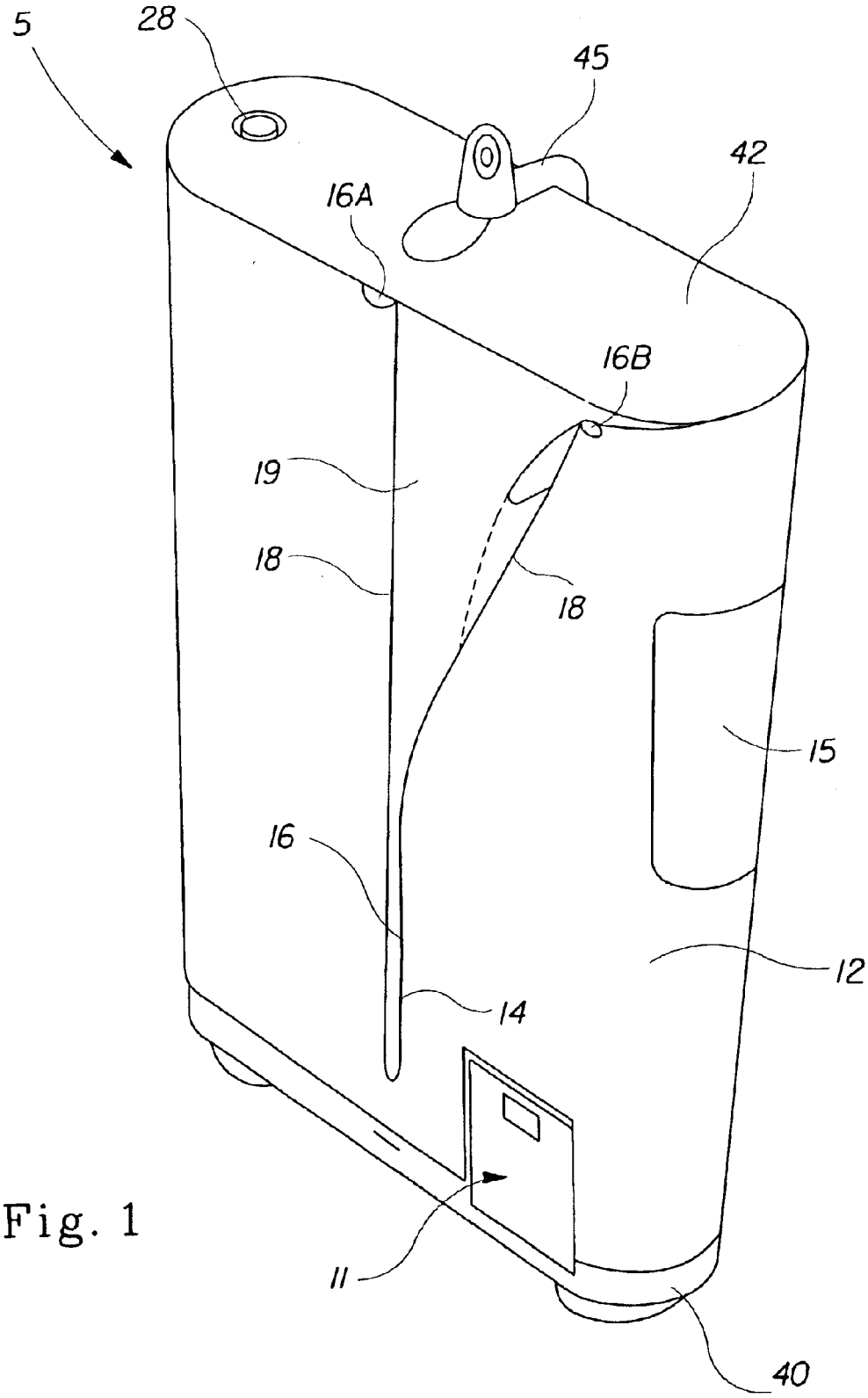
FIG. 1 is a perspective of an apparatus (5) to be used with a system (11) according to the present invention.

The present invention is primarily directed to a system (11) to releasably connect or fit a container (10) to a distribution device (1), which hereafter is also referred to as a distribution device (1), and to a container (10) suitable for use in such a system (11). In a highly preferred embodiment of the present invention, the container and distribution device are, respectively, liquid container and liquid distribution device. The system of the present invention is primarily directed to systems that convey liquids, thus, the different elements constitutive of the present invention will be described as liquid-conveying elements. However, this is not intended to limit the scope of the invention, since the present system can also be used to convey, contain, and distribute over forms of products, such as powders, granules, pills, gases, or the like.

The container (10), preferably a liquid container, fully participates to the achieve efficiency of the system (11). Both the container (10) and the distribution device (1) comprise elements that cooperate to create the system (11).

Throughout the present description, some elements are described as being spring-loaded. The term "spring-loaded" means an element is loaded with a resilient means, for example, a coil spring, a blade, made of any suitable resilient material such as metal, alloy, or plastic. Other examples of resilient means to spring-load a mechanical element include, but are not limited to, various gears, or pneumatic systems using air resilient compression (e.g., air contained inside a closed deformable chamber that is compressed and thus loaded with a resilient elastic energy).

The Distribution Device

The system (11) and/or the container (10) can be used with any type of distribution device (1) or dispensing appliance (1). A distribution device (1) suitable for use in a system according to the present invention comprises a recess (20) for fitting a container, the recess comprises a spring-loaded protrusion (27) for engaging a corresponding path (30) on the surface of the side wall of the container, and the recess further comprises a spring-loaded abutment (26) to assist the fitting and releasing of the container in and out of the recess. Preferably, the device (1) further comprises a basculating door (43) having the recess mounted thereon; the door being hinged to the rest of the device (1) via a hinge or shaft (39). The device (1) may further comprise at least one piercing means (e.g., a needle) to pierce a pierceable membrane of a container when it is inserted into the recess. More preferably, there are two needles: one for sucking out the liquid from the container, and the other for letting air into the container, so as to compensate the loss of volume therein.

The Container

The system (11) of the present invention is created by cooperation of some elements of a container (10) with some elements of a distribution device (1). The container (10) can be any suitable container for containing and dispensing a liquid. Preferably, it is a plastic bottle comprising a bottle body, a bottleneck, linked to the body via bottle shoulders. More preferably, the bottle is made out of a cheap manufacturing process such as extrusion, blow molding or injection blow molding, thermoforming or other suitable FFS (Form-Fill-Seal) processes. The cross-section of the bottle, especially in the region of the body, can have any suitable shape, but it is preferably parallelepipedic or elliptic. In any case, the cross-section of the container body must not be circular, so as to avoid rotating said container (10) when it is placed into the recess (20) of the device (1). Optionally, the container (10) can comprise a handling means, such as built-in handle; however, such a handle must not be positioned such that it could prevent the protrusion of the distribution device (1) to access the guiding path (30). Also preferably, the neck (17) of the container (10) is off-centered relatively to the longitudinal central axis—or rotation axis—of said container (10). It has been found that the stability of the container (10), once inserted into the recess (20) of the device (1), is surprisingly enhanced when the neck (17) of said container (10) is off-centered.

For clarity purposes, it is important to view the container (10) from several orientations in order to better describe it. As shown in FIGS. 4 to 7, the container (10) of the present invention comprises a top (21) and a bottom (22), and container sidewalls (23) that generally correspond to the container's body. The top (21) of the container is defined as the portion that is close to the neck (17) and the dispensing opening (13) of said container (10), and the bottom (22) is the end opposite to the top (21). The axis that passes through the median points of the sections defined by the top (21) and the bottom (22) of the container (10), defines the longitudinal axis of said container (10).

Preferably, the container (10) is a non-refillable container, whose dispensing opening (13) is covered by a nonremovable pierceable closure. The pierceable closure may be, for example, a normal screwed cap with anti-back off ratchets positioned under the screw thread on the inside of the cap's skirt that prevent the cap from being unscrewed from the neck (17) of the container (10). As used herein, the term "pierceable" means that the cap is provided with a pierceable means, preferably a pierceable membrane with elastic properties, made out of polymers with resilient properties, such as synthetic or natural elastomers. Said membrane is to be pierced by at least one corresponding piercing means of the distribution device (1). More preferably, the pierceable means comprises a pierceable septum made out of a laminate, for example, a rubber/PET laminate, such that after being pierced, the septum automatically recloses in a substantially leak-tight manner once the container (10) is removed from the distribution device (1).

The Fitment System

The fitment system or the system (11) of the present invention is created by cooperating elements of the container (10) and the distribution device (1). First, the container (10) comprises at least one guiding path (30) that is made such that it will guide at least one spring-loaded movable protrusion (27) of the recess (20) along path portions that define an open cycle. The guiding path (30) can alternatively be on the distribution device (1), and the movable protrusion (27) can be on the container (10). However, for manufacturing costs reasons, and convenience in the manufacturing processes, it is preferred that the guiding path (30) is on the container (10) and the movable protrusion (27) is on/in the distribution device (1). Second, the distribution device (1) comprises a recess (20) that has a complementary shape to the external shape of the container body (e.g., a recess having generally the same cross-section as the cross-section of the container body), and said recess (20) comprises at least one spring-loaded movable protrusion (27) that can cooperate with the guiding path (30) of the container (10). Preferably, said spring-loaded movable protrusion (27) is a movable pin that releasably engages said guiding path (30) of the container. Said recess (20) of the device (1) comprises a longitudinal axis which is defined as the axis that generally passes through the median points of the cross-sections of the recess, taken from the planes defined by the top (opening) and bottom ends of said recess (20). In addition, it is an essential feature of the system of the present invention that said recess (20) and said container (10) comprise a common longitudinal axis, when said container (10) is inserted, at least partially, in said recess (20).

It is a most preferred feature of the system (11) according to the present invention, that the cross-sections of the container body, and the cross-section of the recess (20) be non-circular, so that once it is inserted into said recess (20), the container (10) cannot pivot inside said recess (i.e. only longitudinal movements of the container are allowed once it is inserted in the recess of the device). Accordingly, the movable protrusion (27) and the guiding path (30) will control the only possible movement (i.e., the longitudinal movement) of the container (10) inside the recess (20).

Figure 6:
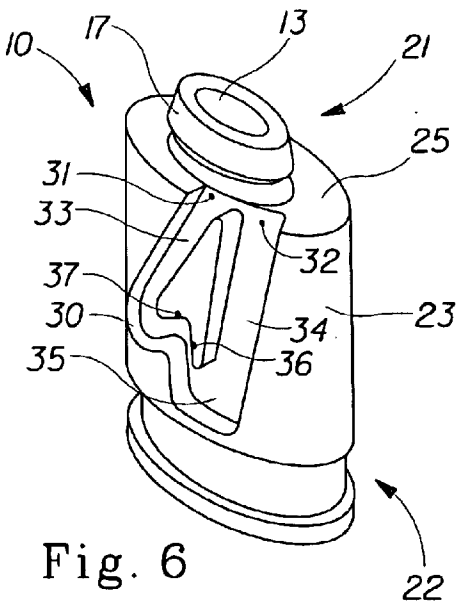
FIGS. 4 to 7 are respectively front, side, perspective, and top views showing a container (10) to be used in a system (11) according to the present invention.
Figure 5:
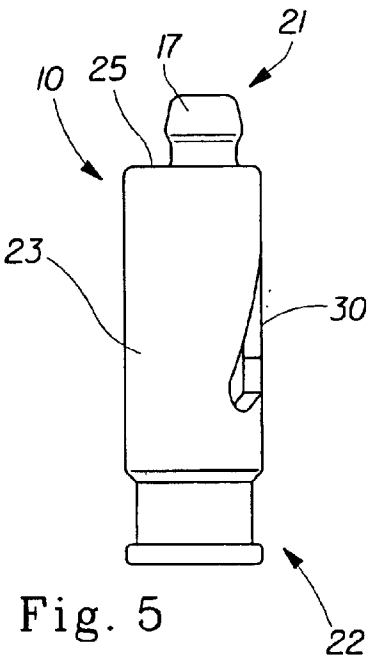
Figure 4:
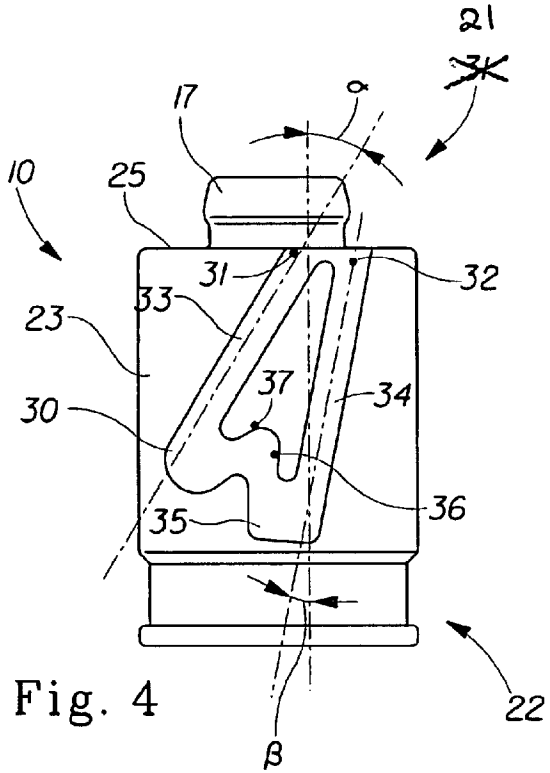
Figure 7:
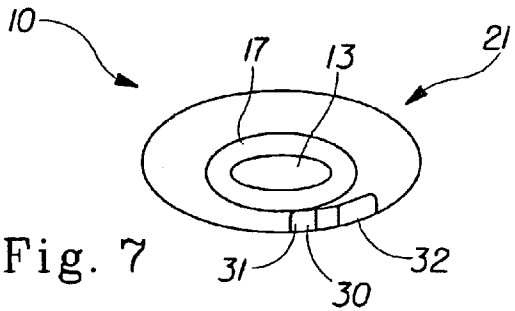

As shown in FIGS. 4 and 6, the guiding path (30) of the container (10) comprises several portions that guide the movable protrusion (27) of the recess (20) when the container (10) is being inserted into said recess (20) by a user applying a pressure on said container (10). Preferably, the entry point (31) and exit point (32) of the movable protrusion (27) into the guiding path (30) are close to each other, so that while sliding in, along, and out of the guiding path (30), the movable protrusion (27) describes a whole cycle. As shown in FIGS. 4 and 6, the guiding path (30) is located on the container (10) in such a manner that when said container (10) is inserted into the device (1), the movable protrusion (27) of the recess (20) automatically faces the entry path portion (33). It is highly preferred that the container (10) to be easily moved in/out of the device (1), and that, during use, the movement of the container (10) relatively to the device (1) is possible along one axis only. More preferably, the movement of the container (10) inside the device (1) is only possible along an axis that is parallel to the longitudinal axis of said container (10). The guiding path (30) further comprises a transition path portion (35) that connects the entry (33) and exit (34) path portions. The transition path portion (35) comprises a stop (36) wherein the movable protrusion (27) is blocked in such a way that the container (10) cannot disconnect from said device (1), unless the user presses once onto the bottom (22) of said container (10). By blocking the movable protrusion (27) in a given position, the stop (36) prevents any longitudinal movement of the container (10) inside the device (1), until the user releases said movable protrusion (27) from said stop (36). As described in detail above, once the container (10) is inserted inside the recess (20), the only possible movement is a sliding movement along the longitudinal common axis of said container (10) and said recess (20). Once the movable protrusion (27) is blocked onto the stop (36) of the transition path portion (35), the container (10) cannot move laterally relatively to the recess (20). Thus, the risk of leakage at the interface between the container (10) and the device (1) is dramatically reduced, if not cancelled.

It is an essential feature of the system of the present invention that the recess (20) of the device (1) comprises a spring-loaded movable abutment (26) that abuts the shoulders (25) of the container (10) when said container (10) is inserted into said recess (20). The abutment (26) of the recess (20) is spring-loaded such that the abutment spring(s) (29) is/are charged with elastic energy when a user pushes onto said spring-loaded abutment (26) of the recess (20), or when the user pushes the container (10) downwards into said recess (20). As shown in FIGS. 4 and 6, the stop (36) has a bottom (37) such that when the movable protrusion (27) of the recess (20) is blocked into the bottom (37) of the stop (36), the container (10) is already pressed downwards into the recess (20) of the device (1). Thus, the abutment springs (29) serve to move the container (10) upwards out of said recess (20). In a first embodiment of the present invention, the pierceable cap or membrane of the container (10) is pierced by the piercing means (47) of the device (1), so as to establish a leak-tight fluid communication between the two, when the container (10) is pressed downwards into the recess (20) by the user, and this fluid communication is maintained while the container (10) is blocked into said recess (20), until the user presses onto said container to remove it from the recess (20). In a second embodiment (FIGS. 2 and 3), which is preferred, the recess (20) is mounted onto a basculating door (43). The fluid communication is not immediately established when the user presses onto the container (10) and blocks it into the recess (20). The user first ensures that the recess (20) is in the open position. The user then inserts a container (10) into the recess (20), making sure that the container (10) is oriented so that its dispensing opening (13) is inserted first. Then, the user presses onto the container (10) to move it downwards into the recess until the movable protrusion (27) clicks and blocks into the stop (36), thus, the bottle (10) is blocked into the recess (20). The user then basculates the basculating door (43), with the recess (20) mounted thereon, around hinge (39) to its closed position, so that when the basculating door is closed, the piercing means (47) of the device (1) has punctured the pierceable cap or membrane of the container (10), thereby establishing a leak-tight fluid communication between the two. In both of the preceding embodiments, a leak-tight fluid communication can be established only when the container (10) is blocked into the recess (20).

Figure 8:
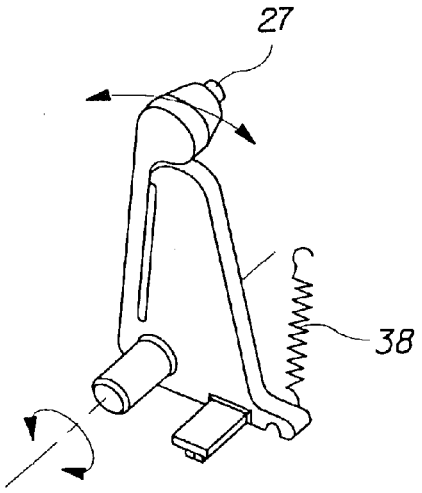
FIG. 8 is a perspective view showing a spring-loaded element of the system (11) according to the present invention that comprises the protrusion (27) that moves along the guiding path (30).

Due to the shape of the stop (36), as shown in FIGS. 4 and 6, the movable protrusion (27) of the recess (20) can only be released from said stop (36) and slide to the exit path portion (34) if the user exerts a pressure onto the container (10) to make it move downwards further into the recess (20), and so that the movable protrusion (27) slides up out of the stop (36) relatively to said container (10). In a highly preferred embodiment of the present invention, as shown in FIG. 8, the movable protrusion (27) of the recess (20) is pivotally mounted around an axis, to allow it to move. It is also spring-loaded, and positioned relatively to the guiding path (30) of the container (10) such that when said movable protrusion (27) engages the entry path portion (33), the spring (38) of said movable protrusion (27) is gradually loaded with elastic energy. When said movable protrusion (27) is blocked into said stop (36), it is still charged with elastic energy, and thus a single press onto the container (10) allows said movable protrusion (27) to escape from said stop (36) and automatically engage the exit path portion (34).

Typically, the guiding path (30) has generally W-shaped contours, and is positioned such that the entry path portion (33) catches the movable protrusion (27) of the recess (20) when the container (10) is inserted into the recess (20). In a first embodiment, as shown in FIGS. 4 to 7, the guiding path (30) is a groove in the surface of the container (10), said groove follows the general contours of said guiding path (30). In a second embodiment, the guiding path (30) is a relief on the surface of the container (10); only the inner contours of the guiding path (30) are defined, which are sufficient for the movable protrusion (27) of the recess (20) to be guided. However, in this second embodiment, an additional protrusion can be added above the stop (36), to prevent the protrusion (27) from escaping said stop (36) and going directly from the entry path portion (33) to the exit path portion (34), when the user presses onto the container. Preferably, the height of the W is as great as possible so that the entry (33) and exit (34) path portions will be more vertical, causing less friction to insert the container (10) inside said recess (20). The size of the movable protrusion (27) is preferably substantially similar to the width of the guiding path (30) when the guiding path (30) is a groove. Obviously, this dimension is not critical when the guiding path (30) is a relief on the surface of the container sidewall.

Preferably, the draft angle of the W defined by the guiding path (30) is adapted to the shape of the movable protrusion (27) of the recess (20), for example 5°. Also preferably, in order to ensure a good performance of the system (11), and especially to facilitate the exit of the container (10) from the recess (20), the exit path portion (34) is steeper than the entry path portion (33). The split plane passing through the guiding path (30) should preferably be parallel to the plane defined by the movement of the movable protrusion (27). However, depending on the shape of the container (10), the guiding path (30) can be located along the portion of an ellipse—when the cross section of the container body is oval—, as shown in FIGS. 4 to 7. Preferably, the draft angles of the entry (33) and exit (34) path portions are as low as possible, so as to give the lowest possible friction force between the movable protrusion (27) and the guiding path (30) when moving said movable protrusion (27) along said guiding path (30). The material for the movable protrusion (27) can be any suitable material with good sliding performance with regards to the material of the container (10). Also preferably, when the draft angles of the entry (33) and exit (34) path portions are not the same, the draft angle ($\alpha$) of the entry path portion (33) is greater than the draft angle ($\beta$) of the exit path portion (34), as shown in FIG. 4.

Figure 3:
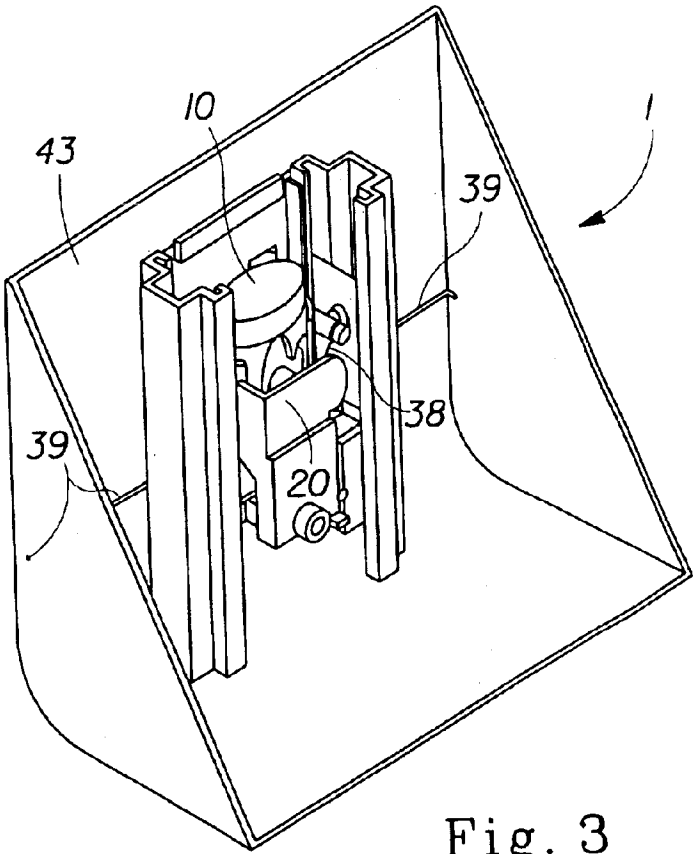
FIGS. 2 and 3 are perspective schematic views of the device (1) used in the context of the present invention, respectively showing: a portion of the interior of the device (1) without the recess or the container mounted therein (FIG. 2), and the device (1) with the recess and with the container mounted therein (FIG. 3).
Figure 2:
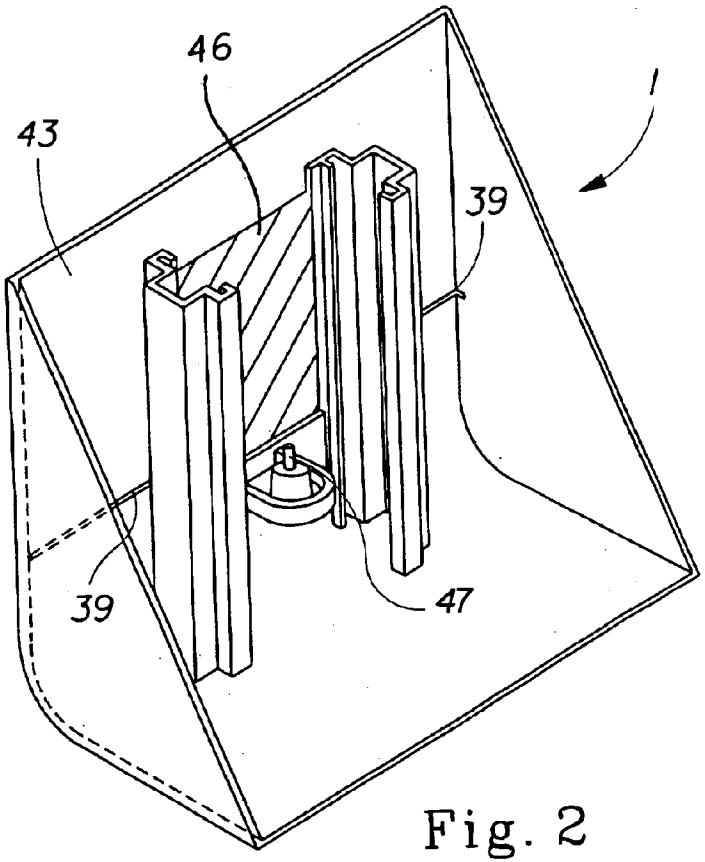
Figure 9:
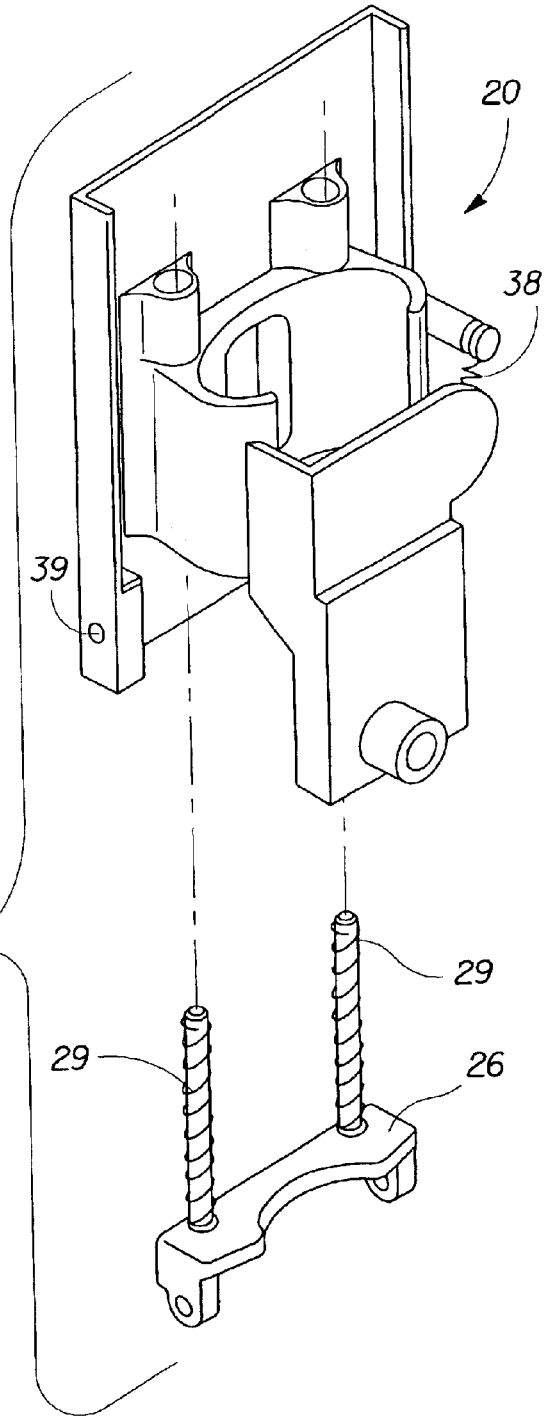
FIG. 9 is an exploded perspective view showing the recess (20) of the device (1) with its spring-loaded movable bottom portion.

In a preferred embodiment of the present invention, the recess (20) of the device (1) is constructed like a drawer that is pivotally mounted onto the device (1) via a basculating door (43) and a hinge (39), as shown in FIG. 9, and also in FIGS. 2 and 3. Such a construction for the recess (20) is especially beneficial in case the container (10) is a bottle with a pierceable cap and the device (1) comprises piercing means to pierce the pierceable cap of the bottle and establish a leak-tight fluid communication between said container (10) and said device (1). In this case, the system should preferably be constructed such that the membrane of the container is pierced only when said container has been fully inserted into said recess of said appliance, and once the door (43) is basculated, i.e. pivoted about hinge (39), into the closed position. It has been found that when the container is oval, i.e. has an elliptic cross-section, the neck (17) of the container (10) should preferably be off-centered with respect to the cross-section of said container, and biased towards the largest arc of the ellipse, since this improves the pierceability and leak resistance of the system (11).

In this system the shape of the container can be extremely beneficial to the robustness of the system. Particularly, the off-centered neck of the container (10) is designed to facilitate piercing of the membrane. Since the container comes down in an arch while basculating the door, the off centered neck helps decreasing possible deformation or stress on the needles.

The Needles Protecting Plate

The container (10), once inside the recess (20), is pierced by two needles of the device (1), thereby establishes a fluid communication between the inside of the container (10) and the device (1). One needle delivers product while the other allows air to flow in the container and compensates the volume of liquid that is dispensed. However, it has been found that access to the needles when the recess (20) does not contain a container (10) should be prevented, for safety reasons.

In order to solve that issue, the system (11) may optionally comprise a movable protecting plate (46) that is movable in one direction along guide rails. Said direction of movement of the protecting plate is chosen to be parallel to the direction of movement of the abutment (26) when the door is closed.

The movable abutment (26) and the basculating door (43) are both connected and movable against each other by means of a spring-like element. The movable abutment (26) of said recess (20) is also linked to the protecting plate via a rigid shaft that is pivotally attached to the abutment (26) and also movably attached to the protecting plate.

When the basculating door (43) is in an open position, the direction of movement of the abutment (26) is no longer parallel to the direction of movement of the protecting plate. Since both are linked by a rigid axis, the movement of the protecting plate is blocked.

When the door is in a closed position, the direction of movement of the abutment (26) is parallel to the direction of movement of the protecting plate, and thus, the movement of the protecting plate is allowed, along its guide rails, and it can give access to the needles.

Method of Using the System

The present invention further describes a method of using a system (11) as described above for distributing a product or composition (preferably a liquid) from a container (10) through a distribution device (1) or a distribution device (1). The distribution of liquid is possible when a substantially leak-tight fluid communication has been established between said container (10) and said device (1). The method of distributing a liquid using the system (11) of the invention comprises the steps of:

(i) inserting said container into said recess in a first released position;

(ii) pushing said container in a direction along its longitudinal axis until said container abuts against said abutment (thereby the abutment springs are charged with energy) and said protrusion reaches said stop in said path, thereby blocking said container in said second position;

(iii) distributing said product;

(iv) pushing said container in a direction along its longitudinal axis until said protrusion is disengaged from said stop in said path, thereby releasing said container to said first position.

A main benefit of the system (11) of the invention, is its simplicity of use. Once the liquid container (10) has been inserted into the recess of the device the user only has to press once onto the bottom (22) of said container (10) to click and block it into the recess (20) of the device (1). By pressing a second time onto the bottom (22) of the container (10), the user releases the movable protrusion (27) from the stop (36) of the guiding path (30), and the container (10) is pushed backwards by the spring-loaded abutment (26) of the recess (20), out of said recess (20).

The Fabric/Garment Treatment Apparatus

In another embodiment of the present invention, the system (11), comprising a container (10) and a distribution device (1), is used in combination with a fabric garments refreshing/cleaning apparatus (5), hereafter this term is used interchangeably with the terms "a fabric treatment apparatus (5)" or "an apparatus (5)".

The apparatus (5) is suitable for use in a cleaning and refreshing method that requires at least two steps, and preferably three. The temperature and relative humidity within the treatment apparatus (5) can be manipulated and controlled to create a warm, humid environment inside the housing (12) of the apparatus (5). This controlled environment volatilizes malodor components in the manner of a "steam distillation" process, and moistens fabrics and the soils thereon. This moistening of fabrics can loosen pre-set wrinkles. Since the fabric articles are hung in the container, new wrinkles do not form. Proper selection of the amount of the vapor, and specifically the amount of water used in the process and, importantly, proper venting of the housing in the present manner can minimize shrinkage of the fabrics. Moreover, if the housing is not vented, the volatilized malodorous materials removed from the fabrics which are not captured by the optional filter, can undesirably be re-deposited thereon.

Relative humidity is a well-known concept to those in the fabric care arts. As used herein, "relative humidity" means the ratio of the actual amount of water vapor in the air to the greatest amount of water vapor the air can hold at the same temperature.

As used herein, "fabric articles" encompasses any and all articles of manufacture that are made at least partially of a natural or manmade fibrous material. Examples of fabric articles include, but are certainly not limited to: toys, shoes, upholstery, garments, carpets, clothes, hats, socks, towels, draperies, etc.

The apparatus suitable for use with a system (11) according to this invention can take a variety of forms. But it is generally preferred that the apparatus (5) comprises a housing (12), preferably a cabinet, that substantially encloses the fabric articles being cleaned and refreshed. By "substantially encloses", it is meant that the fabric articles are enclosed in the housing, but that the housing can, and preferably will, include one or more vents. The housing must have an opening for accessing the fabric articles, and preferably has a bar, hook or other device on which to hang the fabric articles.

The housing preferably has only one wall configured like an eggshell. It has been found that the vapor and the active ingredients preferentially condense in the corners and along the sharp edges of a more conventional rectangular shaped cabinet/enclosure. However, it is understood that the methods of this invention can also be conducted in rectangular cabinets/enclosures. Regardless of its shape, every housing has an "open volume", which means the volume of the housing when it is in use. The housing of this invention is collapsible or expandable and has a substantially reduced volume in its closed or collapsed state.

FIG. 1 is a schematic representation of a fabric treatment apparatus (5) according to the present invention. The collapsible or expandable, preferably flexible walls (18) of housing (12) are preferably made of a flexible material, which is preferably a lined fabric material. And more preferably the lining is a coating applied to the fabric by methods known to those skilled in the art such as transfer coating, direct coating. The housing fabric is preferably selected from the group consisting of cotton, polyester, nylon, rayon and mixtures thereof, and the lining is preferably selected from the group consisting of silicone, polyurethane, polyvinyl chloride and mixtures thereof. Collapsible or expandable walls (18) of housing (12) define an interior void space (19), which is preferably supported by one or more rigid, yet collapsible frames. These frames can be separate from one another, or they can be a unitary structure. Interior void space (19) can be viewed via window (15), which is quite useful when the collapsible or expandable walls (18) are made of an opaque material.

It is understood that while apparatus (5) is shown in a rounded rectangular configuration, the present invention is not meant to be so limited. Apparatus (5) can be any appropriate size and shape to achieve the desired volumetric sizes disclosed herein. Other structural configurations are also appropriate for this invention include, but are not limited to, pyramid, spherical, hemi-spherical, two-sided bag and other like configurations.

Fastening means or fastener (16), can be used to seal opening (14), and can comprise virtually any known sealing device such as zippers, tape, ZIP LOCK® seals and hook and loop type fasteners, for example, VELCRO®. In one preferred embodiment of the present invention, the apparatus (5) comprises fastening means (16) to secure the treatment housing (12) in a closed position. It has been found that there is a risk of accidentally opening the housing (12) while the apparatus (5) is running. There is some risk of injury for the user as apparatus may contain very hot vapors, and/or such compounds as ozone. There is also a risk that the user be injured by inhaling very small particles of nebulized refreshing/cleaning composition, which will go very deep into the respiratory system, which can be undesirable or unhealthy to the user. The fastening means can be of any suitable sort that allows to lock the housing in the closed position. In a first embodiment, it is achieved by a hook (16B) onto the movable portion of the fastener that is caught by a buckle (16A) of the stationary portion of the fastener. Once the user has closed the housing (12), the movable portion of the fastener (16) is close to the buckle, so the user can close the fastener by passing the hook into the buckle. In a second and preferred embodiment of the present invention, the fastening means is achieved by a system similar to the ones used for fastening the seatbelts in cars or planes. In addition, this system is completed by an electrical security latch that is linked to the main power switch of the apparatus. Once the container is closed, the user closes the fastener to lock it. Once the user pushes on the main switch to start a cycle, an electrical contact makes the fastening means impossible to unlock until the end of the cycle.

The housing suitable for use in the present invention preferably comprises a rigid top portion (42) and a rigid bottom portion (40), which gather to form a receptacle for the housing when it is collapsed. If a frame is employed, the rigid portions of the housing can serve a support for the frame; the frame and the rigid portion can be separate items that are not connected to one another. Preferably the frame or frames form a flexible, collapsible structure that when expanded forms a semi-rigid, three dimensional structure. Examples of collapsible structures are known, for example, in U.S. Pahousing No. U.S. Pat. No. 5,038,812, which issued on Aug. 13, 1991, to Norman. In general, flexible, collapsible frames, such as those found in Norman, are formed from material that is relatively strong but nevertheless flexible enough to allow it to be collapsible. An exemplary frame material is flat spring steel having a rectangular cross section with dimensions of 1.6 mm in width and 76 mm in length. The frame or frames can be sewn, glued or otherwise attached to the interior or the exterior of the treatment bag. Likewise, the frame or frames can be free standing with the treatment bag material hanging loosely over, or being expanded by the frame.

As is discussed briefly above, the apparatus (5) is collapsible. That is, the housing (12) can be folded to substantially reduce its volume. More preferably, the housing collapses into a receptacle that can be formed by the rigid portions of the housing, or the receptacle can be a separate item. The receptacle need not be rigid, but can be any suitable storage unit for the collapsed container. Preferably, the housing may comprise a handle that makes it easier to transport the collapsed housing from one place to another. Also preferably, the housing may comprise an exterior hanging means (45), which can be used to hang the apparatus when it is in use and can be used as a handle to carry the receptacle or the collapsed housing when the apparatus is not in use.

To facilitate numerous cycles of collapsing and un-collapsing, the collapsible or expandable, preferably flexible material must be reasonably durable. By durable it is meant that the container should resist mechanical and chemical stress, that is the material should not swell, soften or develop cracks, holes, or other defects during its normal use. Likewise, if the housing is constructed of a lined material, the lining should not deteriorate or exfoliate. In one preferred embodiment of this invention, the housing is also thermally insulated with additional material, or even more preferably, the flexible material is a thermally insulating material. But as is discussed below in the Method description, there is a need for relatively quick "cool-down" of the housing that allows for condensation of the perfume on the fabrics. Thus, the housing should not be perfectly insulated.

The collapsible or expandable, preferably flexible, material should have a natural vapor permeability not higher than 3000, preferably, not higher than 2000, and more preferably not higher than 1000 grams of water/$m^2$/day. Vapor permeability can be measured by a standardized test such as the ASTM E96 test. The collapsible or expandable, preferably flexible, material can be essentially vapor impermeable, but it may be desirable for the walls of the housing to have some limited permeability so the housing can "breathe". Also, the collapsible or expandable, preferably flexible, material should be resistant to chemical corrosion, and ultra violet light. The various materials listed below as suitable cleaning and refreshment composition additives should not damage the housing material over time. Likewise, the apparatus of this invention may be used near a window wherein the sunlight might fade or otherwise damage the housing material. The housing material should be selected to minimize this degradation due to natural sources. Suitable collapsible or expandable, preferably flexible, materials can be purchased from the Milliken Corp., in South Carolina, or the Sofinal Corp., in Belgium.

The housing suitable for use in the present invention can be formed from one sheet of collapsible or expandable, preferably flexible, material or from multiple sheets of material that are joined together in any appropriate manner. Those skilled in the art can contemplate many ways to join multiple sheets of material together to form a housing. For example, the sheets can be sewn together, stapled, adhesively bonded, heat bonded, sonic bonded, or attached to one another by means that are known. The seams of housing, if properly engineered, can form the vent. By properly engineered, it is meant that the welds, stitches, bonds, staples, etc. of the housing should be spaced so as to vent the desired amount of air or vapor during operation. Those skilled in the art will be able to determine the proper seam construct to achieve the desired venting without undue experimentation.

In addition to the at least one wall that defines an interior void space (19), the housing (12) preferably comprises: (a) at least one vent; (b) a temperature controller that is preferably active and is capable of changing and maintaining the air temperature within the interior void space of housing; (c) an ultrasonic nebulizer, which is capable of producing a fine mist out of liquids and which will be used to deliver the refreshing and cleaning composition to the fabrics in the form of very small droplets, and thus, acts as a humidity provider that is capable of maintaining a certain level a relative humidity within said interior void space of the housing; and (d) an air circulation device, for example, a fan.

Temperature and relative humidity controllers are well known to those skilled in the art, as are passive and active controllers. As used herein, an "active" controller is a controller that reads an input and supplies feedback to the device being controlled and that device adjusts based on the feedback received. A "passive" controller, as used herein, is a controller that turns a device on or off, or opens or closes a device, based on a predetermined setting such as time. For example, a passive temperature controller would turn on a heating element or close a vent to increase the temperature in a given environment and after a certain period of time the heating element is turned off or the vent is opened. In contrast, an active temperature controller reads the temperature and if, for example, the temperature is too low, the power to the heating element is increased or the vent is closed to increase the temperature.

Preferably, the active temperature controller, the passive humidity controller, the ultrasonic nebulizer, and the air circulation device are all within the interior void space (19) of housing (12). Each of these mechanical elements will be known to those skilled in the appliance arts, and the size and power of each element can be selected based on the volume of the housing (12). Many manufacturers market these elements, such as, Etri in France, Blackmann in Austria, and IRCA in Italy.

An air circulation device generally has an air inlet and an air outlet. It is preferred that both air inlet and air outlet are located within interior void space so that at least a portion of the air within the interior void space is re-circulated. In some embodiments, an air outlet of the air circulating device is at least about 30 cm, preferably at least about 25 cm, and more preferably at least about 20 cm from vent (28) such that a portion of the air circulated within the interior void space of housing is vented to the exterior of the housing. For the optimum deodorization, it is preferred to have air velocities around the garment between 0.05 to 10 m/s, more preferably between 0.1 and 5, most preferably between 0.5 and 2 m.s−1.

The vent is preferably selected from the group consisting of the natural permeability of the flexible material, seams created between sheets of the flexible material, seams between the housing opening and the flexible material, a void space in the housing material, and mixtures thereof. The void space in the housing material can be any appropriately sized holes or openings.

The apparatus (5) may also comprise a filter. The filter is preferably located at the top or at the bottom of the apparatus, in close proximity to the fan, thereby removing the need for a vent; consequently, the apparatus may work as a closed system. The filter may also be located under a cover plate, in close proximity to the ultrasonic nebulizer. Preferably, the filter is in close proximity or adjacent to the vent. Preferably, the filter comprises an absorbent material, for example, activated carbon, to absorb fugitive chemicals, perfumes, and malodorous compounds before they are emitted to the exterior of the housing. Most preferably, the filter is a low-pressure filter that has a low resistance to air. Typical of such filter are commercially available from AQF under the trade name CPS® or from MHB filtration. Preferably, the surface of the air circulation device, (e.g., a fan) may be partially or totally covered by the filter. When part of the air circulation device is covered, lost of the perfume through the filter is minimized. When the entire air circulation device is covered, one can have the air circulation device automatically switched off at the end of the cycle, thereby enabling deposition of the perfume onto the garment.

In some embodiments, the apparatus or the vent comprises a humidity sink (i.e., a condenser), for condensing vapors before they are emitted from the housing. Condensers and filters are well known to those skilled in the appliance arts.

The apparatus of this invention utilizes very small droplets of refreshing and cleaning composition to clean and refresh fabric articles as described above. Preferably, the temperature of the droplets is higher than room temperature because the refreshing and cleaning composition may be heated by the ultrasonic nebulizer (see more detailed description hereafter). The droplets are typically created within the housing by an ultrasonic nebulizer, which converts a cleaning and refreshment composition, comprising water and actives, into a very fine mist.

The water and actives of the "cleaning and refreshment composition", or "fabric treatment composition" (these two terms are used interchangeably throughout this description and are intended to mean the same thing) can be added to the housing in any appropriate way. The composition can be poured into the housing, or poured into a reservoir that feeds into the ultrasonic nebulizer/humidifier. Alternatively, canisters can be used to inject the composition into the housing, or an absorbent substrate saturated with the composition can be placed in the housing. Substrates and compositions suitable for use in the methods of this invention are described in greater detail below. It is understood that those skilled in the art will know of other methods of adding actives to the housing and those methods are within the scope of this invention.

In a preferred embodiment of this invention, the refreshing and cleaning composition in contained inside a container (10) that is removably connected to the apparatus (5) via a system (11) of the present invention. Preferably, the container is not refillable and comprises a pierceable cap, which may comprise a pierceable membrane. In such a case, the device (1) of the system (11) comprises at least one piercing means, (e.g., a needle) that pierces the pierceable cap when the container (10) is inserted into the device (1), thus establishes a fluid communication between the two. Preferably, the membrane is an elastomeric pierceable membrane that is inserted and maintained onto/into the cap. More preferably, the membrane is made such that once it has been pierced, it recloses so as to be substantially leak-tight. For example, leak-tight reclosable pierceable membranes can be made out of a laminate elastomer/PET membrane.

As discussed above, the apparatus useful in this invention comprises an ultrasonic nebulizer and an air circulation device that work together to vaporize and distribute the cleaning and refreshment composition. By "work together" it is meant that the ultrasonic nebulizer is in operative communication with the air outlet of the air circulation device such that, as air is being circulated within the interior void space of the housing, it circulates across and around the ultrasonic nebulizer. Moreover, it is especially preferred that the ultrasonic nebulizer be in fluid communication with a fabric treatment composition, which is converted into a fine mist. The high frequency waves generated by the ultrasonic nebulizer detaches droplets of liquid from the liquid surface to form a fine mist, thus heating of the liquid is not required. The fine mist thus produces comprises small droplets of liquid with a diameter preferably comprised within the range of 1 to 35 $\mu$m, more preferably within the range of 1 to 20 $\mu$m. A fine mist of droplets differs from vapors in that the former contains droplets of liquid, while the vapors are made of separate molecules of liquid. However, the fine mist produced by the nebulizer of the present invention is similar to vapors regarding their ability to penetrate into the fabrics. More importantly, it has been shown that the coverage of the surface of the garment being treated is equal to that achieved with vapors, that is, almost 100% of the surface of the fabric garment is covered by the mist. In contrast, applying the refreshing/cleaning composition by a hand triggered spray would only provide localized (i.e., spotty) coverage. As the air is circulated across the ultrasonic nebulizer, it picks up and carries the nebulized fabric treatment composition with it such that the nebulized fabric treatment composition is circulated throughout the interior void space of the housing.

As previously explained, the vapor is supplemented by a nebulizer, which is used to cover the surface of the fabric garments with a fine mist of volatile and non-volatile cleaning and refreshment compositions. Preferably the nebulizer is an ultrasonic device, most preferably providing droplets size between 1–60 microns, most preferably between 1–40 microns. Nebulizers, atomizers and the like devices that are appropriate for use in the present invention are well known to those skilled in the art. A suitable device for use herein is a nebulizer that has at least one ultrasonic sonotrode, or ultrasonic vibrating cell. Typical of such nebulizer is commercially available from Sono Tek Corporation, 2012 route 9W Building 3 in Milton N.Y. 12547 under the trade name Acu Mist®. If used, it is preferred to have frequency set up to at least 60 kHz, most preferably to at least 100 kHz so as to obtain droplets sizes below 60 microns, more preferably below 50 microns, most preferably below or equal to 40 microns. Still other examples of such devices can be purchased from the Omron, Health Care, GmbH, Germany, Flaem Nuove, S.P.A, Italy. Likewise, aerosol delivery systems, which are well known to the art, can be used to deliver the cleaning and refreshment compositions.

In some embodiments, the nebulizer preferably comprises protected cells. Indeed, a problem encountered with the use of cell containing nebulizer is their contamination from contact with the cleaning/refreshing composition, thereby causing build-up on the cell. As a result, the lifetime of the cells is shortened. It has now been found that protection of the cells, in particular by contacting the cells with a protective liquid or gel medium, e.g., demineralized water, the latter being covered by a membrane, so that this system is closed, i.e. leak-free, solved this problem. Furthermore, it has been found that by adding certain substances to demineralized water and using the resulting mixture as the protective medium, the output is greatly increased. Preferably, the liquid/gel ultrasonic cell protective medium is a mixture of demineralized water with alcohol or more preferably a mixture of demineralized water with a surfactant. A person skilled in the art can appropriately choose the right proportions of alcohol or surfactant. The membrane provides the closing of the system but does not prevent the energy waves transmittal The thickness of the membrane should be optimized so as to transmit the wavelengths and energy coming from the ultrasonic cells at the best rate. Preferably, the thickness of the membrane is less than 200 $\mu$m, more preferably less than 100 $\mu$m, even more preferably less than 50 $\mu$m. Most preferably, the thickness of the membrane is equal or less than 10 $\mu$m. It has been found that the thinner the membrane, the better the transmission of the wavelengths. In addition, it has been found that a very efficient transmission of energy from the ultrasonic cells to the refreshing and cleaning composition is achieved via a membrane thickness that is less than 200 $\mu$m. As a result, the lifetime of the cells are greatly enhanced. One advantage of this system is that it can be run empty of cleaning/refreshment composition without the risk of destroying the cell and thus the nebulizer. Preferably, the membrane is a layer made of plastic film, and/or made of metal. Typical description of such apparatus can be found in BE 9900683 filed 14 Oct. 1999 in the name of Brodsky SPRL. This finding is all the more surprising as previous attempts to solve this problem were by level detectors. However, this did not prevent the build-up from the cleaning/refreshment composition onto the cell. In addition, it has been found that the distance between the top of the ultrasonic cells and the membrane affects the output rate of the ultrasonic nebulizer, for given type of protective medium, ultrasonic frequency, type and thickness of the membrane. It has further been found that each system presents several maxima (typically one or two), i.e. distances for which the output is greatly increased—which means the output rate of the nebulizer is not a linear function of the distance between the ultrasonic cells and the membrane.

Another means to improve the low output of the nebulizer has also been found which relates to another problem encountered with conventional nebulizer, that is, the coalescence of the droplets. As the droplets are emitted into the air, the higher they are, the more they coalesce into giving bigger droplets, which tend to fall back into the basin of the nebulizer. This problem is solved in a simple manner by the addition of a blowing means like a fan, which is preferably located on top of the nebulizer so as to provide a horizontal airflow, which directs the flow of small droplets through a grid. Typical description of such apparatus can be found in BE 9900682 filed 14 Oct. 1999 in the name of Brodsky SPRL.

It has been found that the output of the ultrasonic nebulizer should be preferably at least 2 g/min, more preferably at least 3 g/min, per piezoelectric cell. This is crucial to achieve a sufficient distribution of the composition and/or product onto the garment. It has been found that known ultrasonic nebulizers cannot achieve such an output. In addition, it has surprisingly been found that by warming up the protective liquid or gel medium that surrounds or encapsulates the ultrasonic cells, the output is greatly increased. Thus, the nebulizer should comprise a built-in heating means to warm up the protective medium that protects the ultrasonic cells. It has been found that the output is greatly increased for the same ultrasonic cell power, especially when the temperatures of the protective liquid are above about 30° C. At this point, it is important to note that the process of warming the protective liquid is by no means intended to vaporize the refreshing and cleaning composition, in contrast to the apparatuses known in the art which use steaming systems. In the system used in the present invention, the benefit is achieved already for temperatures just above the room temperature. Of course, it has been shown that the higher the temperature, the better the output. However, an effective increase of the output can already be achieved at the protective liquid temperatures of above 30° C., more preferably above 40° C., and most preferably above 50° C.

Fabric articles can be suspended in the interior void space (19) of the treatment apparatus (5) by any appropriate method. One such method uses a bar to suspend hangers. The garments hung in treatment apparatus can also be weighted or stretched to improve wrinkle reduction. Hanging weights and stretching devices are described below. Preferably, the garments to be treated are mechanically stretched after placing them into the treatment apparatus and before starting the process. This stretching or so-called tensioning of the garment helps the relaxation of wrinkles during the process. Preferred stretching systems include weighted as well as lightweight compactable or retractable stretching systems, wherein the system comprises a tensioning device like a spring. The latter systems have the benefit of not adding extra weight to the treatment apparatus, along with the possibility of adjusting tensioning force and direction as required. Preferably, these systems are mounted inside the treatment apparatus at its bottom. One example of such as system is a roller blind that is conventionally used as sun filter for cars and commercially available from Halfords. This system is a roller blind, which can be extended or compacted by means of a roll-up spring mechanism. Only slight modification of this system is needed to adapt it to the tensioning of garment. One preferred adaptation involves attaching the housing of this system at the bottom of the treatment apparatus and providing one or more clamp at the other side so that the clamping and thus the stretching or tensioning of the garment in the apparatus is obtained. The tension of the spring can also be adjusted to the desired stretching force for a given garment. The size of the clamp can vary so that more than one clamp is attached to this system. Still, another variation involves having only one clamp that runs along or partially along the blind tensioning system located opposite the housing of the system. The minimal force applied to the garments by the stretching system should preferably be about 7 N (Newtons).

The treatment apparatus (5) can be free standing with the support of a rigid frame, or it can be suspended by an exterior hanging member (45) from a support means (not shown). If treatment apparatus (5) is suspended by an exterior hanging member (45), no frame is required, although frames are generally preferred to control and maintain the shape and volume of interior void space (19). In a preferred embodiment of the present invention, the housing (12) further comprises a rigid bottom portion (40), a rigid top portion (42) or both. These two rigid portions can be used to support the frame, house the mechanical elements of apparatus (5), and/or to serve as a housing for the collapsed housing. Moreover, rigid bottom portion (40) and rigid top portion (42) can be designed to enhance the aesthetic characteristics of the apparatus, that is, the rigid portions need not have any functionality.

The apparatuses used in the context of this invention must simultaneously clean and refresh fabrics with vaporous compositions, and vent out the malodorous vapors. It is understood that separating the desirable treatment or active vapors from the malodorous vapors would be a complex task. A Volume Refreshment Rate of the apparatus has been determined that optimizes the venting of malodorous compounds while minimizing the loss of active components from the cleaning and refreshment composition.

The Volume Refreshment Rate is defined as the frequency that the total volume of air within the interior void space of the housing is replaced, expressed in units of seconds$^{-1}$. If the apparatus vents substantially lower than 0.0004 $s^{-1}$, then venting is too weak and deodorization performance deteriorates, unless the cycle length is drastically increased. Theoretically, one volume refreshment per cycle can be enough to allow good deodorization. Supposing, for example, a cleaning and refreshment cycle takes 1 hour, of which the deodorization step would take approximately 40 minutes, this would mean a Volume Refreshment Rate of 0.0004 $s^{-1}$.

The Volume Refreshment Rate for the apparatus (5) is preferably between about 0.0004 $s^{-1}$ and about 0.05 $s^{-1}$, and more preferably between about 0.001 $s^{-1}$ and about 0.03 $s^{-1}$.

Method of Using the Apparatus

The present section describes a preferred way to refresh/clean fabrics using an apparatus (5) suitable for use with a system (11) according to the present invention. Especially, the method steps referred to hereafter in this section, can be incorporated within step (iii) of the method for using a system (11) according to the present invention, which is described in the beginning of the present description. That is, the use of the system (11) comprising the device (1) and the container (10) to distribute a liquid from said container (10) onto the garments in a housing (12), in order to refresh/clean them.

To properly clean and refresh a fabric article, one must address many aspects of the article's appearance. Specifically, the fabric article should at least be substantially free of odor and wrinkles after a cleaning and refreshing operation. It is often preferred that the article be perfumed to give it a pleasant smell, and it should be free of localized stains. The methods that can be applied with a fabric garments refreshing/cleaning apparatus (5), comprising a system (11) according to the present invention, require at least two steps designed toward deodorizing, dewrinkling and/or perfume deposition on a fabric article. Additionally, a manual spot removal step for removing localized stains is provided, but the spot removal step is conducted outside of the apparatus (5). The conditions for each of these methods/steps are described in greater detail below.

While the refreshing/cleaning method can be carried out in any appropriate order, the deodorization step will be discussed first. Deodorization must be distinguished from odor-masking, which involves applying a pleasant scent to a fabric to mask or cover up the malodors on the fabric. Deodorization, as used herein, involves the actual removal or degradation of malodor causing chemicals. When the malodor causing chemicals are removed or neutralized, the fabric article should have little or no residual malodor. This step of the process can be carried out with ozone, which degrades odors, or with high temperatures and venting, which remove the odor causing chemicals.

The deodorization step is described herein as the first step as a matter of convenience. It is understood that the deodorization and dewrinkling steps can be carried out in any order. If a perfume deposition step is employed, it necessarily should follow the deodorization step, so that the perfume is not stripped off of the fabric immediately after it is laid down.

When deodorization is the first step carried out at a first temperature and a first relative humidity, the first temperature should be at least about 45° C., preferably at least about 60° C., and most preferably at least about 70° C., and the first relative humidity should be least about 20%. At these relatively high temperatures, odor-causing chemicals are stripped off of fabrics, and then preferably removed from the container via the vent. Even more preferably, the vent comprises a filter so that the odorous emanations do not enter the environment outside of the container. When the first temperature and first relative humidity are reached, the process time of the deordorizing step (referred to as the "first time") can be from about 2 minutes to about 20 minutes, preferably from about 5 minutes to about 15 minutes, and even more preferably from about 8 minutes to about 12 minutes.

The deodorization step described above can be supplemented, or even replaced by treating the fabric articles with ozone. The use of ozone to neutralize odors causing chemicals and to sanitize fabric articles, for example, medical gowns, is well known to the art. Specifically see, published pahousing applications DE 24 33 909 and FR 2059 841, both of which are incorporated herein by reference. One or more ozone sources can be used and they can be placed in any convenient place in, or adjacent the exterior of the housing (12). The ozone source must be sized according to the volume of the housing, with consideration for the surface area of the fabric articles being cleaned and refreshed. For purposes of the methods disclosed herein, ozone can be introduced into the container from any appropriate source, such as an ultraviolet lamp or even a high voltage source. An example of the high voltage source can be a wire placed in the housing and approximately about 10,000 volts are passed across the wire. This generally serves the same purpose as the UV lamp generating ozone. Those skilled in the art will know what type and size of equipment to use for a given housing.

The second step of the fabric garments refreshing/cleaning method described herein is directed to dewrinkling, which requires relatively high temperature and high relative humidity. Good air circulation that agitates the fabrics and evenly distributes the active ingredients is beneficial to the dewrinkling step, but not necessary. The dewrinkling step is carried out at a second temperature and a second relative humidity. The second temperature should be greater than "T" which is defined by the equation:

$$T=60-(0.17*RH_2)$$

wherein $RH_2$ is the second relative humidity in percent. $RH_2$ is of at least about 50%, preferably of at least about 75%, more preferably of at least about 85%, most preferably at least about 90%. Preferably, the second temperature is less than about 90° C., more preferably less than about 80° C., and most preferably less than about 70° C. When the second temperature and second relative humidity are reached, the process time of the dewrinkling step (referred to as the "second time") can be from about 2 minutes to about 20 minutes, preferably from about 5 minutes to about 15 minutes, and even more preferably from about 8 minutes to about 12 minutes.

Finally, there is preferably a third step involving a gradual cool down of the interior void space (19). As the temperature decreases, the amount of vapor retained in the air decreases, because the vapors begin to condense when the air becomes saturated. Naturally, vapors will condense on the fabric articles inside the housing, and as these articles dry, the active ingredients, such as perfume, remain behind. As discussed briefly above, these steps are designed to deliver actives without undue waste and without saturating the fabrics to the point that they need additional drying. Preferably, during the third step in the process, the temperature within the interior void space decreases to a third temperature, which is less than about 45° C., preferably less than about 40° C., and more preferably less than about 35° C. The duration of the third step (referred to as the "third time") ranges from about 2 minutes to about 20 minutes, preferably from about 3 minutes to about 10 minutes, and even more preferably from about 3 minutes to about 5 minutes.

As discussed in greater detail below, the vapor inside the housing (12) is preferably a cleaning and refreshment composition. The composition can be delivered by a container (10) and the cleaning and refreshment composition is released from the container into the interior void space of the housing.

The Cleaning/Refreshment Composition

The cleaning/refreshment composition preferably comprises water, and optionally, an active selected from the group consisting of surfactants, perfumes, preservatives, bleaches, auxiliary cleaning agents, fabric shrinkage reducing compositions, organic solvents, wrinkle removing (i.e., dewrinkling) agents, in-wear anti-wrinkling agents, semi-durable press agents, odor absorbing agents, and mixtures thereof. Said composition can include both volatile and non-volatile ingredients. Both of which can be vaporized/nebulized into a fine mist for deposition onto the garments. The preferred organic solvents are glycol ethers, specifically, methoxy propoxy propanol, ethoxy propoxy propanol, propoxy propoxy propanol, butoxy propoxy propanol, butoxy propanol, ethanol, isopropanol, and mixtures thereof. Fabric shrinkage reducing compositions that are suitable for use in the present invention are selected from the group consisting of ethylene glycol, all isomers of propanediol, butanediol, pentanediol, hexanediol and mixtures thereof. More preferably, the fabric shrinkage reducing compositions are selected from the group consisting of neopentyl glycol, polyethylene glycol, 1,2-propanediol, 1,3-butanediol, 1-octanol and mixtures thereof. The surfactant is preferably a nonionic surfactant, such as an ethoxylated alcohol or ethoxylated alkyl phenol, and is present at up to about 2%, by weight of the cleaning/refreshment composition. Preferred auxiliary cleaning agents include cyclodextrins and dewrinkling agents, such as silicone containing compounds. Especially preferred anti-wrinkling agents include volatile silicones, some of which can be purchased from the Dow Corning Corporation. One such volatile silicone is D5 cyclomethicone decamethyl cyclopenta siloxane. Typical fabric cleaning/refreshment compositions herein can comprise at least about 80%, by weight, water, preferably at least about 90%, and more preferably at least about 95% water.

Specific ranges and more detailed descriptions of the individual components of the cleaning/refreshment compositions, that is, the organic solvents, surfactants, perfumes, preservatives, bleaches and auxiliary cleaning agents can be found in U.S. Pahousing No. U.S. Pat. No. 5,789,368, which issued on Aug. 4, 1998 to You et al.; and co-pending U.S. Pahousing application Ser. No. 08/789,171, which was filed on Jan. 24, 1997, in the name of Trinh et al. Detailed descriptions of the shrinkage reducing compositions for use in this invention can be found in co-pending U.S. Provisional Application No. 60/097,596, entitled "Cleaning Compositions that Reduce Fabric Shrinkage", which was filed by Strang and Siklosi, on Aug., 24, 1998.

It has been found that addition of a certain amount of alcohol into the refreshing/cleaning composition, typically a liquid composition, diminishes the surface tension of said composition, as well as its viscosity. Thus, the composition is much easier to vaporize/nebulize into fine particles by the ultrasonic nebulizer, thus, achieving a higher output rate of the nebulizer. Similarly, the addition of a certain amount of surfactant into the refreshing and cleaning composition diminishes its surface tension, and renders the composition much easier to be vaporized/nebulized into a fine mist, hence a higher output rate of the nebulizer. This is one of the reasons making alcohol, surfactant, or any other surface tension reducing chemical compound a preferred component of the refreshing/cleaning composition.

All along the description of the present invention, the output rate of the ultrasonic nebulizer refers to a dry output rate. By "dry output", it is meant that the fine mist produced by the ultrasonic nebulizer is a non-wetting mist. This is due to the fact that the sizes of the particles making up the mist are very small. In addition, given the very small particle sizes, the distribution of the composition onto a surface is very regular. Thus, all area of the fabric articles are evenly treated with the nebulized composition, and localized deposition of the composition which would lead to wetting of the garments or the interior of the refreshing/cleaning apparatus is avoided. Such small sizes of particles are achieved by providing the top portion of the nebulizer with a fan. It is recognized that the particles produced by the nebulizer are even in size. As described before, a fan can be used to suspend the smaller particles in the air to form a fine mist, and to allow the larger particles to be re-deposited onto the surface of the refreshing/cleaning composition.

Optional Pre-treatment Processes a. The Spot Cleaning Compositions

The present invention also includes an optional pre-spotting procedure, which uses a spot cleaning compositions to remove localized stains from the fabrics being treated, either before or after the cleaning/refreshing process. Necessarily, the spot cleaning composition must be compatible with the fabric being treated. That is, no meaningful amount of dye should be removed from the fabric during the spot treatment and the spot cleaning composition should leave no visible stains on the fabric. To not leave visible residues on the treated fabrics, the preferred spot cleaning compositions are formulated to contain a very high level of volatile materials, preferably water, typically about 95%, preferably about 97.7%. The spot cleaning composition may also contain surfactant at levels of about 0.1% to about 0.7%. A preferred spot cleaning composition will also contain a cleaning solvent, such as butoxy propoxy propanol (BPP), at a low but effective level, typically about 1% to about 4%, preferably about 2%.

Preferred spot cleaning methods and compositions are described in U.S. Pahousing No. U.S. Pat. No. 5,789,368, to You et al. and in U.S. Pahousing No. U.S. Pat. No. 5,630, 847, which issued on May 20, 1997, to Roetker.

b. The Treatment Member

In one embodiment, a treatment member is provided to assist in removing localized stains from fabrics. In a preferred aspect of this invention, the spot cleaning composition is provided in a dispenser, such as a bottle, and the dispenser has a distal tip that can serve as the treatment member. Additionally, the treatment member can comprise an absorbent base material which can be, for example, a natural or synthetic sponge, an absorbent cellulosic sheet or pad, or the like. In contact with and extending outward from this base material can be multiple protrusions. Specific examples of treatment members can be found in U.S. Pahousing No. U.S. Pat. No. 5,789,368, to You et al.

In another embodiment, the treatment member to assist in removing localized stains from fabrics can be a hand-held tool and can be built-in with the treatment apparatus. By "hand-held", it is meant that while said member is built-in, i.e. attached and not removable from the treatment apparatus, it must be carried and manipulated by the user, for example, like a pen that is linked to the main apparatus (5) by a wire.

In addition, it has been found that an ultrasonic implement has the advantage of providing a very efficient means to remove difficult stains. It can have a shape and size that is compatible with the user's hand and easy to manipulate by hand. Additionally, it can be arranged in a compartment located in the housing of the refreshing/cleaning apparatus (5). In a preferred embodiment, said hand-held ultrasonic pre-treatment implement has an active part (i.e. sonotrode) vibrating at a frequency of at least 20 kHz and an amplitude of at least 10 $\mu$m and up to 100 $\mu$m. It is preferably shaped generally like a pen, and is attached to the main apparatus by a wire that provides power to the ultrasonic part. Also preferably, the wire comprises a pipe that is capable of transporting a composition to the ultrasonic nozzle and dispensing the composition to the stain being treated, thus, enhances the spot-removal process.

One example of an ultrasonic implement for treatment of fabrics, suitable for pre-treatment of fabric garments, is given in Procter & Gamble's U.S. pahousing application Ser. No. 60/165784, filed 16$^{th}$ Nov. 1999. An example of the structure of an ultrasonic implement suitable for use as a pre-treatment implement for removing localized stains on fabric garments can also be found in Procter & Gamble's PCT application No. WO 00/28874, published 25$^{th}$ May 2000.

c. The Absorbent Stain Receiving Article

An absorbent stain-receiving article, sometimes referred to herein as a "stain receiver", can sometimes be used in the optional spot cleaning processes herein. Such stain receivers can be any absorbent material, which imbibes the liquid composition used in the spot cleaning process. Disposable paper towels, cloth towels such as BOUNTY™ brand towels, clean rags, etc., can be used. However, in a preferred embodiment, the stain receiver is designed specifically to "wick" or "draw" the liquid compositions away from the stained area. One preferred type of stain receiver consists of a nonwoven pad, such as a thermally bonded air laid fabric ("TBAL"). Another highly preferred type of stain receiver for use herein comprises polymeric foam, which comprises a polymerized water-in-oil emulsion, sometimes referred to as "poly-HIPE". The manufacture of polymeric foam is very extensively described in the pahousing literature; see, for example: U.S. Pahousing No. U.S. Pat. No. 5,260,345 to DesMarais, Stone, Thompson, Young, LaVon and Dyer, issued Nov. 9, 1993; U.S. Pahousing No. U.S. Pat. No. 5,550,167 to DesMarais, issued Aug. 27, 1996, and U.S. Pat. No. 5,650,222 to DesMarais et al., issued Jul. 22, 1997. Typical conditions for forming the polymeric foams of the present invention are described in co-pending U.S. Pahousing application Ser. No. 09/042,418, filed Mar. 13, 1998 by T. A. DesMarais, et al., titled "Absorbent Materials for Distributing Aqueous Liquids". Additional disclosure of conditions for forming the polymeric foams for use in the present invention are described in co-pending U.S. Provisional Pahousing Application Serial No. 60/077,955, filed Mar. 13, 1998 by T. A. DesMarais, et al., titled "Abrasion Resistant Polymeric Foam And Stain Receivers Made Therefrom".

The various stain receivers suitable for use herein may further comprise a liquid impermeable backsheet. The backsheet can be made of, for example, a thin layer of polypropylene, polyethylene and the like. The backsheet serves to protect the surface that the stain receiver rests on from the spot cleaning composition. For example, spot cleaning processes are typically performed on a hard surface, such as a table top. The stain receiver is placed on the table and the fabric to be treated in placed on the stain receiver. Spot cleaning composition is applied to the stained area of the fabric and then drawn into the stain receiver. But in the absence of a back sheet, the spot cleaning composition can leak onto the table top, possibly causing damage thereto.

While particular embodiments of the present invention have been illustrated and described, it would be apparent to those skilled in the art that various other changes and modifications can be made without departing from the spirit and scope of the invention. It is therefore intended to cover in the appended claims all such changes and modifications that are within the scope of this invention.

What is claimed is:

1. A system for fitting a container to a distribution device comprising:

(i) a liquid distribution device comprising a recess; and (ii) a container comprising a liquid composition, said container comprising a top, a bottom, and a side wall having an external surface extending between the top and the bottom, said container being releasably engageable in said recess;

wherein (a) said recess and said container comprise a common longitudinal axis;

(b) said recess comprises a protrusion which engages a corresponding path on said surface of said side wall when said container is fitted in said recess;

(c) said path comprises a stop for said protrusion;

(d) said recess comprises an abutment for said container;

(e) said container can be fitted in said recess in a first, released position and a second, blocked position, and a fluid communication between said container and said device can only be established when said container is fitted in said second position; and (f) said container is switcheable between said first and second positions by pushing said container once in a direction along its longitudinal axis.

2. The system according to claim 1 wherein said path comprises two portions elongated in the general direction of said longitudinal axis, said portions having a top end towards the top of the container and a bottom end towards the bottom of said container, and said portions are linked at their bottom end by a transition portion, said transition portion comprising a stop for blocking said protrusion when said container is engaged in said recess in said second position.

3. The system according to claim 1 wherein said path is a groove.

4. The system according to claim 1 wherein said path is a relief.

5. The system according to claim 1 wherein said path has a W shape.

6. A method for distributing a product comprising (i) providing a system according to claim 1;

(ii) inserting said container into said recess in said first position;

(iii) pushing said container in a direction along its longitudinal axis until said container abuts against said abutment, and said protrusion reaches said stop in said path, thereby blocking said container in said second position;

(iv) distributing said product; and (v) pushing said container in a direction along its longitudinal axis until said protrusion is disengaged from said stop in said path, thereby releasing said container to said first position.

7. A container suitable for use in a system according to claim 1 wherein said path comprises two portions elongated in the general direction of said longitudinal axis, said portions having a top end towards the top of the container and a bottom end towards the bottom of said container, and said portions are linked at their bottom end by a transition portion, said transition portion comprising a stop for blocking said protrusion when said container is engaged in said recess in said second position.

8. The container according to claim 7 wherein said path is a groove.

9. The container according to claim 7 wherein said path is a relief.

10. The container according claim 7 wherein said path has a W shape.

11. The container according to claim 7 wherein said container comprises a pierceable membrane.

12. The container according to claim 11 wherein said membrane is reclosable after it has been pierced.

13. The container according to claim 11 wherein said membrane is made of a PET/elastomer multilayer material.

14. The device according to claim 12 wherein the device is housed within an apparatus for cleaning and/or refreshing garments.

* * * * *

UNITED STATES PATENT AND TRADEMARK OFFICE

CERTIFICATE OF CORRECTION

PATENT NO. : 6,845,888 B2
DATED : January 25, 2005
INVENTOR(S) : Verherbrugghen et al.

It is certified that error appears in the above-identified patent and that said Letters Patent is hereby corrected as shown below:

Title page,
Insert Item -- [30] Foreign Application Priority Data
October 4, 2000 (EP)……..00870222.7 --

Signed and Sealed this

Thirty-first Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,845,888 B2
APPLICATION NO. : 10/370998
DATED : January 25, 2005
INVENTOR(S) : Verherbrugghen et al.

It is certified that error appears in the above-identified patent and that said Letters Patent is hereby corrected as shown below:

On the title page, item:
(73) Omit "Proctor 7 Gamble Company" and insert --Procter & Gamble Company--

Signed and Sealed this

Twenty-seventh Day of November, 2007

JON W. DUDAS
*Director of the United States Patent and Trademark Office*